United States Patent [19]

Antoniello

[11] Patent Number: 4,876,749

[45] Date of Patent: Oct. 31, 1989

[54] TWIST DRAIN

[75] Inventor: Frank Antoniello, Commack, N.Y.

[73] Assignee: I.W. Industries, Inc., Melville, N.Y.

[21] Appl. No.: 271,731

[22] Filed: Nov. 15, 1988

Related U.S. Application Data

[63] Continuation-in-part of Ser. No. 183,256, Apr. 8, 1988, abandoned, which is a continuation-in-part of Ser. No. 68,619, Jun. 30, 1987, abandoned.

[51] Int. Cl.[4] ..... A47K 1/14; F16K 31/50

[52] U.S. Cl. ..... 4/295; 4/204; 251/339

[58] Field of Search ..... 4/204, 205, 286, 287, 4/295; 251/214, 144, 339, 88, 208

[56] References Cited

U.S. PATENT DOCUMENTS

| | | | |
|---|---|---|---|
| 3,198,016 | 8/1965 | Poorman | 251/339 |
| 3,247,767 | 4/1966 | Aslan | 251/214 |
| 3,285,298 | 11/1966 | Gellman | 251/339 |
| 3,370,827 | 2/1968 | Stehlin | 251/14 |
| 3,417,960 | 12/1968 | Stehlin | 251/144 |
| 3,797,805 | 3/1974 | Nielsen | 251/214 |
| 4,111,392 | 9/1978 | Edelmann | 251/214 |
| 4,369,531 | 1/1983 | Swanson | 4/295 |
| 4,586,203 | 5/1986 | Westgerdes | 4/287 |
| 4,597,112 | 7/1986 | Cushera | 4/287 |

*Primary Examiner*—Henry J. Recla
*Assistant Examiner*—Robert M. Fetsuga
*Attorney, Agent, or Firm*—Alfred M. Walker

[57] ABSTRACT

A twist drain has a cylindrical twist drain element which is mountable on a tail piece and has a holding member and a rotatable member which rotates between open and closed positions to permit and interrupt a flow of fluid through the twist drain, a thread provided between the holding and rotatable members to rotatably connect them with one another, and a seal which prevents penetration of debris and foreign matter to the thread.

8 Claims, 3 Drawing Sheets

Fig. 2a
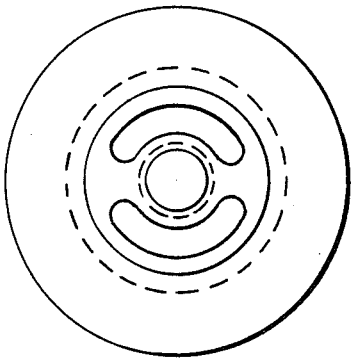
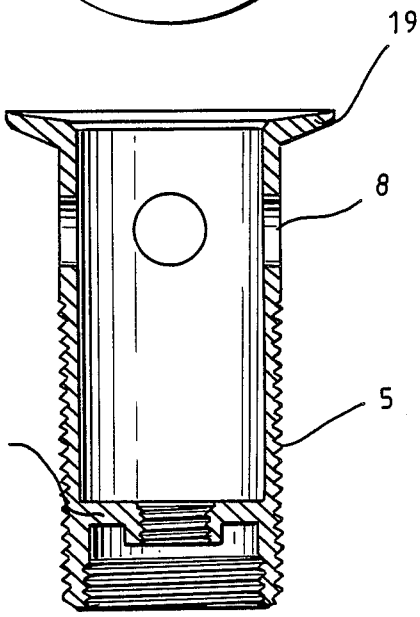
Fig. 2b
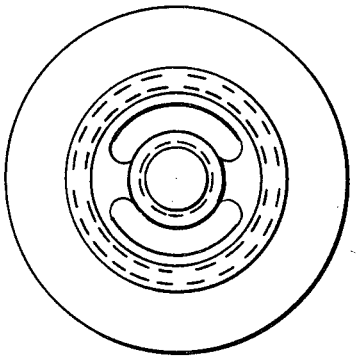
Fig. 2C

TWIST DRAIN

This is a continuation-in-part of application Ser. No. 07/183,256, filed Apr. 8, 1988, now abandoned, which in turn is a continuation-in-part of application Ser. No. 07/068,619, filed on June 30, 1987, now abandoned.

BACKGROUND OF THE INVENTION

1. Field of the Invention

The present invention relates to a twist drain for use in a sink and is particularly usable with a quick twist to open and close the drain. The twist drain cap is screwed one or more turns and then provides a seal to retain water in the sink. To release the retained water, the twist drain cap is unscrewed one or more turns.

2. Description of the Prior Art

Various sink drains are discussed below. Most drains require a lift rod biased to the drain seal to raise and lower the seal.

A drain is disclosed in Mortimer, U.S. Pat. No. 1,630,352 in which a tread stop is used in conjunction with laterally projecting pins. Mortimer does not provide a friction reducing means for repeated movements of the stem nor the capability to position the stem without the application of direct pressure.

A further drain is disclosed in Reagan, U.S.Patent No. 3,465,372 and relates to a twist drain requiring a set screw for engaging a plug means.

Other devices having twist drains in combination with other parts are disclosed in Ingram, U.S. Pat. No. 4,381,569, Wolfferts, U.S. Pat. No. 1,876,817, Minella, U.S. Pat. No. 3,314,086, Good, U.S. Pat. No. 1,275,419, and Brotz, U.S. Pat. No. 1,811,170.

None of the prior art devices fulfills a long felt need for a twist drain utilizing a quick twist with a minimum force required. This long need is derived from the fact that sink drains require retaining means to allow the open and closed positions of the drain seal.

Westgerdes, U.S. Pat. No. 4,586,203 discloses another twist drain of a different construction. This twist drain however does not insure the prevention of debris and foreign matter so that they are not collected in the thread region of the device.

SUMMARY OF THE INVENTION

Accordingly, it is an object of the present invention to provide a twist drain which avoids the disadvantages of the prior art.

More particularly, it is an object of the present invention to provide a twist drain which opens and closes a drain seal without separate retaining means to hold a seal member in open and closed positions and at the same time reliably protects a thread area from debris and foreign matter.

In keeping with these objects and with others which will become apparent hereinafter, one feature of the present invention resides, briefly stated, in a twist drain which includes a generally cylindrical drain element mountable over the tail piece and including a holding element and a rotating element which rotates relative to the holding element between open and closed positions to respectively permit and prevent a flow of fluid through the twist drain, thread means which rotatably connect the rotating element to the holding element, and at least one annular seal provided in said thread for preventing passage of debris and foreign matter into the twist drain.

When the twist drain is designed in accordance with the present invention, it attains the above specified objects.

The novel features of the present invention are set forth in particular in the appended claims. The invention itself, however, will be best understood from the following description of preferred embodiment which is accompanied by the following drawings.

BRIEF DESCRIPTION OF THE DRAWINGS

FIGS. *2a, 2b, 2c* are a top view, a side view and a bottom view, respectively, of a cylindrical outer member of a twist drain element of the twist drain in accordance with the present invention.

DESCRIPTION OF A PREFERRED EMBODIMENT

Figure 1:
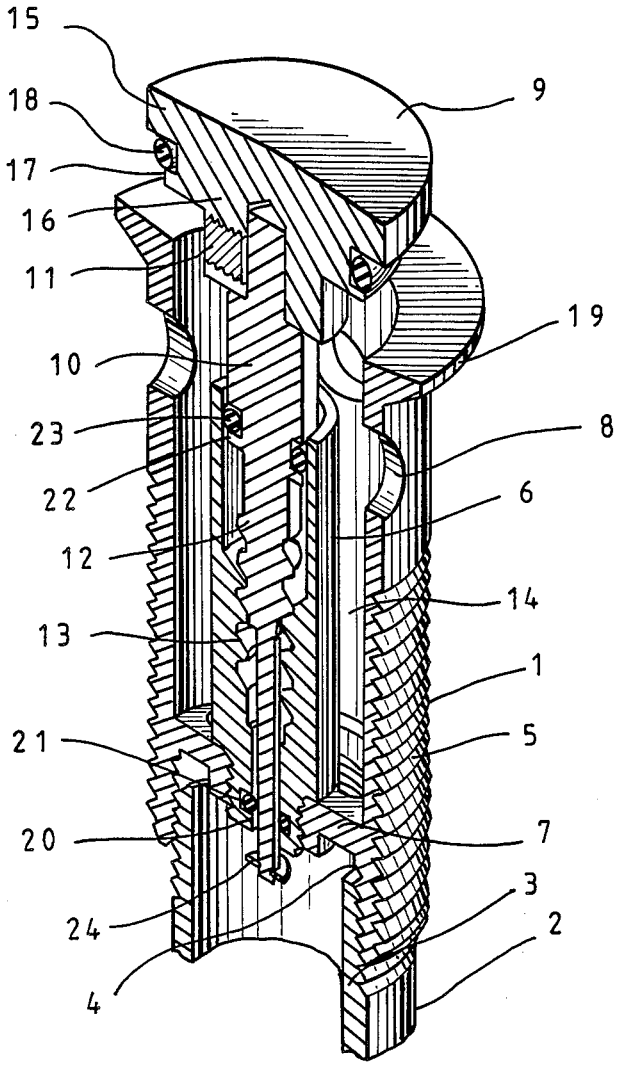
FIG.1 is a perspective view showing a twist drain in accordance with the present invention.
Figure 3:
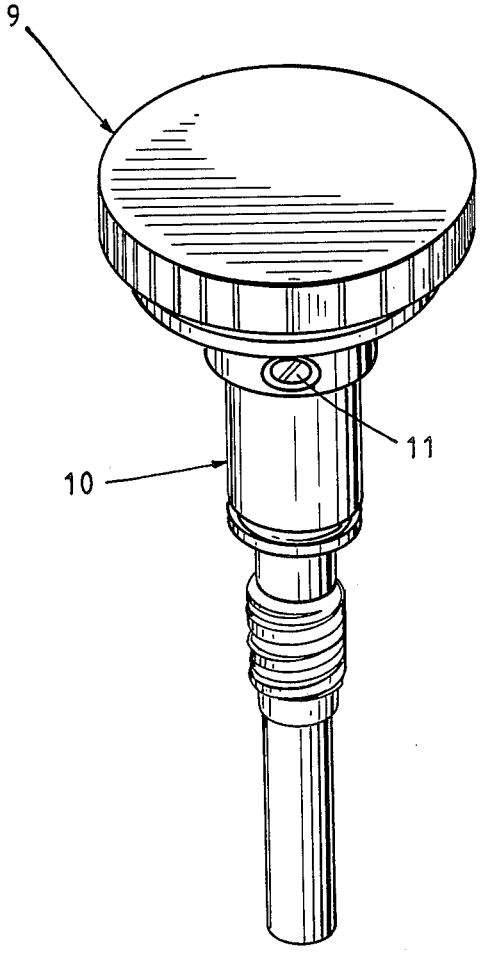
FIG.3 is a side view of a rotatable member of the twist drain element in accordance with the present invention.

A twist drain in accordance with the present invention has a cylindrical drain element which is identified as a whole with reference numeral 1. The cylindrical drain element 1 is securely mounted over a sink tail piece 2 by means of interengaging threads 3 and 4 provided on the outer surface of the tail piece and the inner surface of an outer cylindrical member of the cylindrical drain element, respectively. A cylindrical holding member 6 is supported in the outer member 5 by braces 7 and connected with the outer member 5 by interengaging threads. The outer member 5 is provided with a flange 19 at its upper end. It may also be provided with several flanges on its outer surface to prevent overflow. Overflow holes 8 are provided in the outer member 5 to prevent overaccumulation of water.

The drain element further has a rotatable member which includes a disc-shaped handle cap 9 which is mounted on a stem 10. A set screw 11 connects the handle cap 9 with the stem 10. The set screw can be removed for cleaning. The stem 10 of the rotatable member is provided with an outer thread 12. The stem is surrounded by the holding member 6 which is formed as a jacket. The jacket is provided with an inner thread 13 which is engageable with the outer thread 12 of the stem 10. The outer diameter of the holding member 6 of the drain element 1 is smaller than the inner diameter of the outer member 5 so that a space 14 is left therebetween for the flow of fluid, such as water.

The head cap 9 has an upper portion 15, a lower portion 16, and an annular groove 17 provided therebetween. A resilient O-ring 18 is accomodated in the groove 17 so as to minimize friction when the lower portion 16 of the head cap 9 engages in an upper portion of an inner opening of the outer member 5.

The handle cap 9 is rotated one or more turns before the twist drain element 1 permits the flow of water in an open position. To interrupt the flow of water in a closed position, the handle cap is rotated in a reverse direction one or more turns.

To insure the retention of water in a sink basin in which the twist drain element 1 operates, the handle cap 9 is rotated clockwise one or more times until the O-ring 18 makes a complete surface contact with the inner surface of the inner opening of the outer member 5. The flange 19 covers the hole in the sink in which the twist drain element 1 is located. To drain the water from the sink basin, the handle cap 9 is rotated counterclockwise one or more turns, thus permitting the exit flow of water through the space 14.

In accordance with a very important feature of the present invention, the holding member or jacket 6 is provided in its lower end with an annular groove 20 which accomodates an O-ring 21. The stem 10 of the rotating member is provided in the region of an upper end of the holding member 6 with an annular groove 22 which accomodates an O-ring 23. Therefore no debris and foreign matter can enter between the threads 12 and 13 and collect there, thus assuring a very long period of smooth operation.

The twist drain has a built-in stop which is formed as a clip 24. The clip is provided on the lower end of the stem 10 of the rotating member and located in a small groove. When cleaning is desired, the handle cap 9 is rotated to the stop. The handle cap can be removed by releasing the screw 11, and the cleaning is accomplished. Simultaneously the O-ring 18 can be exchanged.

The invention is not limited to the details shown since various modifications and structural changes are possible without departing in any way from the spirit of the present invention.

What is desired to be protected by Letters Patent is set forth in the appended claims.

1. A twist drain, comprising a cylindrical drain element mountable on a tail piece, and including a brace, a holding member, said holding member supported within said cylindrical drain element by said brace, and a rotatable member which is supported in said holding member rotatably between open and closed positions and including closure means to respectively permit and interrupt a flow of fluid through the twist drain, between said cylindrical drain element and said holding member;

thread means rotatably connecting said rotatable member with said holding member;

sealing means located in the region of said thread means and sealing the latter so as to prevent penetration of debris and foreign matter to said thread means;

said sealing means includes at least one O-ring provided between said rotating member and said holding member in the region of said thread means; and said sealing means includes a further such O-ring provided between said rotating member and said holding member in the region of said thread means, said rotating member and said holding member being extended lengthwise in an elongated direction, said thread means including a first thread provided on said holding member and a second thread provided on said rotating member and engageable with said first thread, each of said threads having two ends spaced from one another in the lengthwise elongated direction, said O-rings being located outwardly beyond said ends of said threads as considered in the lengthwise elongated direction.

2. The twist drain according to claim 1, wherein said holding member is provided with a first annular groove accomodating one of said O-rings, while said rotating member is provided with a second annular groove which accomodates the other of said O-rings.

3. The twist drain according to claim 1, wherein said closure means comprises a removable head cap, said head cap mounted upon said rotating member for rotating said rotating member and also for permitting and interrupting the flow of fluid.

4. The twist drain according to claim 3, wherein said drain element has an outer member which surrounds said holding member so as to form therebetween a space for passing the flow of fluid, said head cap being formed so that in response to rotation of said head cap with said rotatable member said head cap opens and closes said space, and further comprising sealing means located between said outer member and said head cap so as to seal said space when said head cap closes the latter.

5. The twist drain according to claim 4, wherein said head cap has a groove, said sealing means located between said outer member and said head cap including an O-ring accomodated in said groove of said head cap.

6. The twist drain according to claim 3, wherein said rotatable member is provided with a stop member arranged so that said rotatable member can be rotated to a stop for removing said head cap from said rotatable member for cleaning.

7. The twist drain according to claim 6, wherein said rotatable member has two ends spaced from one another, one of said ends of said rotatable member being releasably connected with said head cap, while the other of said end holds said stop.

8. The twist drain according to claim 7, wherein said other end of said rotatable member has a groove, said stop being formed as a clip accomodated in said groove and extending outwardly beyond the latter.

* * * * *